US010460868B2

(12) United States Patent
Kawai

(10) Patent No.: US 10,460,868 B2
(45) Date of Patent: Oct. 29, 2019

(54) IGNITION COIL FOR INTERNAL COMBUSTION ENGINE

(71) Applicant: DENSO CORPORATION, Kariya, Aichi-pref. (JP)

(72) Inventor: Kazuhide Kawai, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/507,430

(22) PCT Filed: Jul. 17, 2015

(86) PCT No.: PCT/JP2015/070599
§ 371 (c)(1),
(2) Date: Feb. 28, 2017

(87) PCT Pub. No.: WO2016/031427
PCT Pub. Date: Mar. 3, 2016

(65) Prior Publication Data

US 2017/0309397 A1 Oct. 26, 2017

(30) Foreign Application Priority Data

Aug. 29, 2014 (JP) ..... 2014-175866

(51) Int. Cl.
*H01F 38/12* (2006.01)
*F02P 3/02* (2006.01)
*H01F 27/02* (2006.01)

(52) U.S. Cl.
CPC ..... *H01F 38/12* (2013.01); *H01F 27/022* (2013.01); *F02P 3/02* (2013.01)

(58) Field of Classification Search
CPC ..... F02P 3/02; H01F 27/22; H01F 2038/122; H01F 38/12
(Continued)

(56) References Cited

U.S. PATENT DOCUMENTS 3,470,598 A * 10/1969 Berthelsen ..... B29C 47/025 228/142
5,008,643 A * 4/1991 Heritier-Best ..... F02P 3/02 336/198
(Continued)

FOREIGN PATENT DOCUMENTS

JP 2000182858 A * 6/2000
JP 2001-196248 7/2001
(Continued)

*Primary Examiner* — John M Zaleskas
(74) *Attorney, Agent, or Firm* — Nixon & Vanderhye P.C.

(57) ABSTRACT

An ignition coil for an internal combustion engine is provided with a primary coil, a secondary coil, a center core, an outer peripheral core, a core cover, a case, and a filling resin. The core cover is formed to cover an inner surface, a surface on one end in the penetration direction, and a surface on the other end in the penetration direction of the outer peripheral core. The core cover has a one end-side cover part, that is, a portion located on a high voltage side of the secondary coil, the cover part facing the surface on one end of the outer peripheral core in the penetration direction, and being formed with a wall portion having an inner surface, an outer surface and a surface on one end in the penetration direction, all of which are formed with a plurality of continuous grooves. The plurality of continuous grooves are filled with the filling resin for filling in the case.

10 Claims, 7 Drawing Sheets

(58) Field of Classification Search
USPC ..... 123/634; 336/90, 96
See application file for complete search history.

(56) References Cited

U.S. PATENT DOCUMENTS

| | | | | |
|---|---|---|---|---|
| 2005/0253232 | A1* | 11/2005 | Ibaraki | H01L 23/3114 257/678 |
| 2007/0026196 | A1* | 2/2007 | Ogawa | H01L 21/4857 428/157 |
| 2012/0092120 | A1* | 4/2012 | Yoshikawa | H01F 27/022 336/220 |

FOREIGN PATENT DOCUMENTS

| | | | | | |
|---|---|---|---|---|---|
| JP | 2002075758 | A | * | 3/2002 | |
| JP | 2003-086439 | | | 3/2003 | |
| JP | 2004095589 | A | * | 3/2004 | |
| JP | 2006-278380 | | | 10/2006 | |
| JP | 2006269843 | A | * | 10/2006 | |
| JP | 2006278380 | A | * | 10/2006 | |
| JP | 2007-194364 | | | 8/2007 | |
| JP | 2007194364 | A | * | 8/2007 | |
| JP | 2008034561 | A | * | 2/2008 | H01F 38/12 |
| JP | 2008-124357 | | | 5/2008 | |
| JP | 2013026560 | A | * | 2/2013 | |
| JP | 2014165449 | A | * | 9/2014 | |
| JP | 2014229684 | A | * | 12/2014 | |

* cited by examiner

IGNITION COIL FOR INTERNAL COMBUSTION ENGINE

CROSS-REFERENCE TO RELATED APPLICATION

This application is the U.S. national phase of International Application No. PCT/JP2015/070599 filed Jul. 17, 2015 which designated the U.S. and claims priority to Japanese Patent Application No. 2014-175866 filed Aug. 29, 2014, the entire contents of each of which are incorporated herein by reference.

TECHNICAL FIELD

The present application relates to an ignition coil for an internal combustion engine for generating a spark for ignition in a spark plug.

BACKGROUND ART

Ignition coils are generally provided with a case in which an assembly of a primary coil, a secondary coil, and a center core and an outer peripheral core are arranged, and gaps in the case are filled with a resin. The shape of such an ignition coil depends on whether the assembly is arranged outside or inside of a plug hole. The configuration in which the assembly is arranged outside of the plug hole is advantageous in that the ignition performance can be designed without being affected by the constitution of the ignition coil, which depends on the inner diameter of the plug hole.

For example, PTL 1 discloses an ignition coil device for an internal combustion engine including a primary coil, a secondary coil, a center core and a side core which are buried in an insulation material and disposed on the outside of a plug hole. In this ignition coil device, the side core is covered with a core cover, with a stress relaxing material being arranged an outer peripheral part configuring the core cover. The stress relaxing material relaxes a stress generated in the insulation material due to the difference in thermal expansion between the core and the cover to prevent the insulation material from being cracked.

CITATION LIST

Patent Literature

[PTL 1] JP-A-2003-86439

SUMMARY OF INVENTION

In PTL 1, it is necessary to separately prepare a stress relaxing material and therefore the number of components is increased. Further, the stress relaxing material is a thin film separate from the side core. Therefore, when the side iron provided with the stress relaxing material is inserted in the case of the ignition coil device, there is the risk that the stress relaxing material might possibly be rubbed off from the inner wall of the case. Therefore, the assembling of the ignition coil device requires labor, and sufficiently preventing the insulation material from being cracked becomes difficult to achieve.

A gap may be provided between the stress relaxing material and the inner wall of the case. This however leads to another problem of increasing the size of the ignition coil device.

The present invention has been made for the purpose of providing an ignition coil for an internal combustion engine capable of reducing the occurrence or progression of separation in the interface between the core cover and the filling resin, and extending the lifetime of the ignition coil.

In an aspect of the present invention, an ignition coil for an internal combustion engine includes a primary coil, a secondary coil disposed concentrically around the outer periphery of the primary coil, a center core disposed on the inner periphery of the primary coil, an annular outer peripheral core surrounding the secondary coil, a core cover formed to cover an inner surface, a surface on one end in a penetration direction and a surface on the other end in the penetration direction of the outer peripheral core, a case provided with an accommodation opening on a side on which the surface on one end of the outer peripheral core in the penetration direction is located, the opening accommodating the primary coil, the secondary coil, the center core, the outer peripheral core, and the core cover and a filling resin filling gaps in the case. In the ignition coil, the core cover has a portion facing the surface on one end of the outer peripheral core in the penetration direction, that is, a portion located on a high voltage side of the secondary coil, the portion being formed with a wall portion having an inner surface, an outer surface, and a surface on one end in the penetration direction, at least one of the surfaces, being formed with recesses or steps, and the filling resin is in contact with the recesses or the steps.

In the ignition coil for an internal combustion engine (which may also be simply referred to as ignition coil), the shape of the core cover which covers the outer peripheral core is devised. The core cover covers the inner surface, the surface on one end in the penetration direction, and the surface on the other end in the penetration direction in the outer peripheral core to relieve a thermal stress produced in the filling resin due to the difference of a coefficient of thermal expansion of the outer peripheral core.

The interface between the core cover and the filling resin is brought into a state in which separation is easily caused by the thermal stress produced in the filling resin due to the difference in the coefficient of thermal expansion between the outer peripheral core and the filling resin. The separation caused in the interface between the core cover and the filling resin progresses toward an end in the penetration direction of the core cover over the interface. When the separation reaches the corners of the core cover at the end in the penetration direction, cracks are generated in the filling resin due to the stress concentration. It is known that, thereafter, the cracking progresses to an end surface of the filling resin located at the opening of the casing. Specifically, the high voltage side of the secondary coil, will have a high voltage, and thus, is likely to suffer from voltage leaking due to the occurrence of cracks.

The core cover has a portion facing the surface of the outer peripheral core on one end in the penetration direction, that is, a portion located on a high voltage side of the secondary coil. The portion is formed with a wall portion which is formed with recesses or steps for resisting thermal contraction of the filling resin caused in the heating and cooling cycle of the ignition coil, or for preventing the separation from progressing to cracks.

In the case where the recesses or the steps are formed in the surface on one end in the penetration direction of the wall portion of the core cover, when the filling resin thermally contracts during the heating and cooling cycle of the internal combustion engine, portions of the filling resin in contact with the recesses or the steps are latched by the recesses or the steps. Consequently, the thermal contraction of the filling resin is suppressed to prevent the occurrence of separation. If the separation occurs, the development of separation can be suppressed, whereby cracking is unlikely to occur. Therefore, the lifetime of the ignition coil is extended.

On the other hand, in the case where the recesses or the steps are formed in the outer surface of the wall portion of the core cover, the separation that has occurred in the interface between the core cover and the filling resin, in the vicinity of the corner located on the surface on one end in the penetration direction of the outer peripheral core progresses over the interface between the recesses or the steps and the filling resin. In the case where the recesses or the steps are formed in the inner surface of the wall portion of the core cover, the separation caused at the interface between the core cover covering the corners of the outer peripheral core and the filling resin progresses over the interface between the recesses or the steps and the filling resin.

In these cases, a creepage distance can be increased. The creepage distance in these cases is a distance through which separation progresses to a corner at an end of the core cover in the penetration direction. Therefore, separation is unlikely to progress to the corner at an end of the core cover in the penetration direction. Moreover, the cracking in the filling resin is suppressed to extend the lifetime of the ignition coil.

In the ignition coil, the occurrence or the progression of separation is suppressed by forming the recesses or the steps in the wall portion of the core cover. The core cover does not require the use a stress relaxing material or the like which is prepared separately from the core cover, and the labor for the assembling of the ignition coil does not increase. Furthermore, without need for forming gaps in the case accompanying for the arrangement of the stress relaxing material or the like, the ignition coil is prevented from becoming large.

Therefore, with the aforementioned ignition coil for an internal combustion engine, the occurrence or the progression of separation in the interface between the core cover and the filling resin is suppressed, and the lifetime of the ignition coil is extended.

In the aforementioned ignition coil for an internal combustion engine, the recesses may preferably be constituted by at either a plurality of continuous grooves formed in the wall portion so as to be parallel to each other along an annular direction in of the outer peripheral core, or a plurality of recessed holes repeatedly formed in the wall portion along the annular direction of the outer peripheral core, and along a direction orthogonal to the annular direction.

In the case where a plurality of continuous grooves or a plurality of recessed holes are formed in the surface on one end in the penetration direction of the wall portion, when the filling resin thermally contracts during the heating and cooling cycle of the internal combustion engine, portions of the filling resin filled in the plurality of continuous grooves or the plurality of recessed holes are latched together to the plurality of continuous grooves or the plurality of recessed holes. Accordingly, the occurrence of separation in the interface between the core cover and the filling resin is effectively prevented. On the other hand, in the case where a plurality of continuous grooves or a plurality of recessed holes are formed on the outer surface or the inner side surface of the wall portion, the separation progressing to a corner of one end in the penetration direction of the core cover is effectively suppressed.

Either the plurality of continuous grooves or the plurality of recessed holes may preferably be formed in all of the inner surface, the outer surface and the surface on one end in the penetration direction of the wall portion.

In this case, the occurrence and the progression of separation in the interface between the core cover and the filling resin is most effectively suppressed.

The steps may preferably be formed in the inner surface and the outer surface of the wall portion so as to have a step shape in which a width between the inner surface and the outer surface of the wall portion becomes gradually narrower toward one end in the penetration direction.

In this case, when forming the core cover, an undercut is prevented from being formed in releasing the formed core cover from the metal mold. In this case as well, the progression of separation in the interface between the core cover and the filling resin is suppressed.

The above and other objects, the features and advantages of the present invention will be readily apparent and fully understood from the following detailed description of preferred embodiments, taken in connection with the appended drawings.

DESCRIPTION OF THE EMBODIMENTS

Hereinafter, some embodiments of the present invention will be described in greater detail with reference to the appended drawings. This invention may, however, be embodied in many different modes and should not be construed as limited to the embodiments set forth herein. Rather, these embodiments are provided so that the disclosure of the invention will be thorough and complete, and will fully convey the scope of the invention to those skilled in the art. It should be noted that the like reference signs indicate the like components throughout the drawings (First Embodiment)

Figure 1:
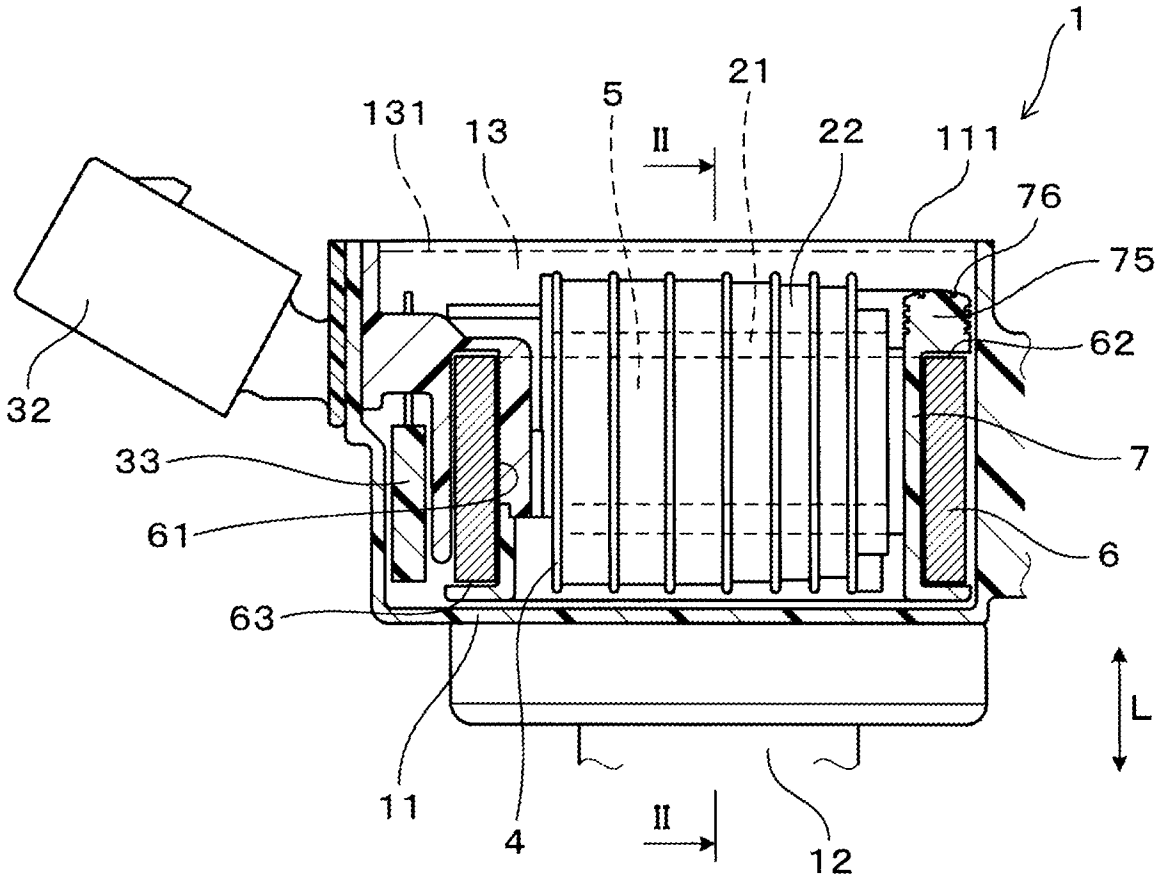
FIG. 1 is a cross-sectional view illustrating an ignition coil, according to a first embodiment.
Figure 2:
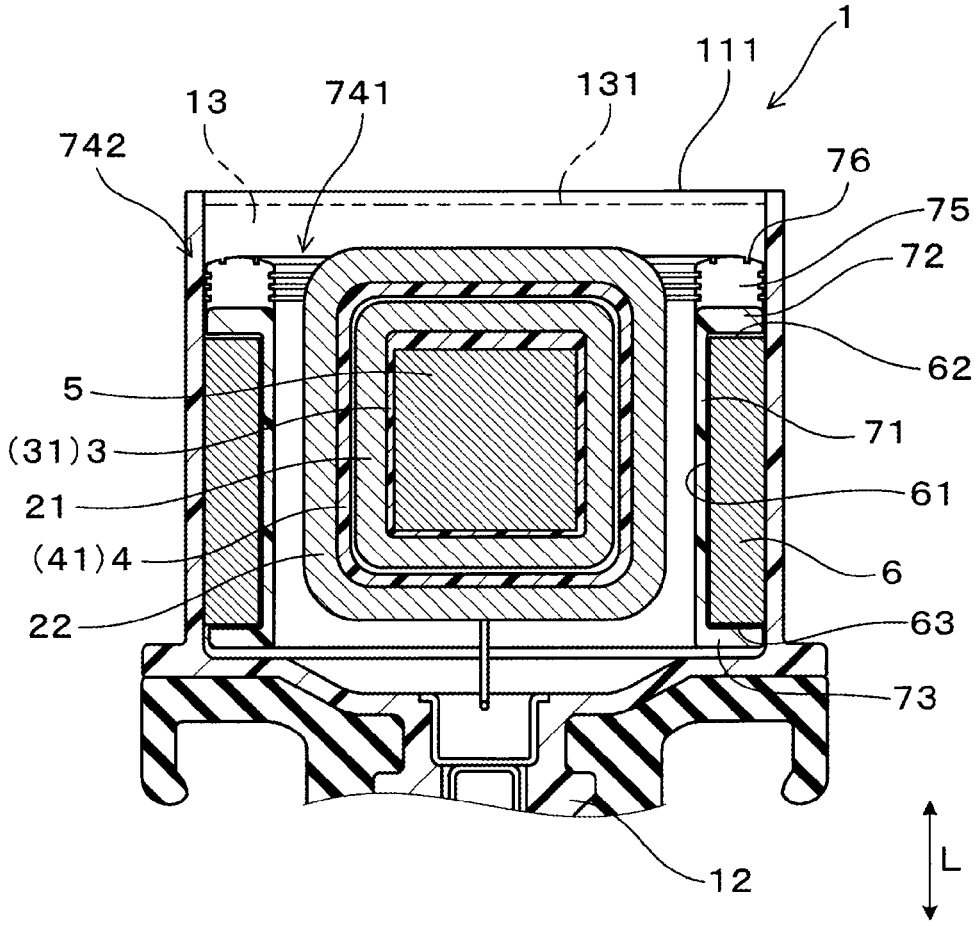
FIG. 2 is a drawing illustrating the ignition coil that is, a cross-sectional view taken along line II-II of FIG. 1, according to the first embodiment.

As shown in FIGS. 1 and 2, an ignition coil for an internal combustion engine 1 of the present embodiment (hereinafter, simply referred to as ignition coil 1), is provided with a primary coil 21, a secondary coil 22, a center core 5, an outer peripheral core 6, a core cover 7, a casing 11, and a filling resin 13. The secondary coil 22 is arranged concentrically on the outer periphery of the primary coil 21. The center core 5 is formed of stacked electromagnetic steel sheets, and arranged on the inside of the primary coil 21. The outer peripheral core 6 is formed of stacked electromagnetic steel sheets, and has an annular shape surrounding the secondary coil 22. The core cover 7 is formed to cover an inner surface 61, a surface 62 on one end in a penetration direction L, and a surface 63 on the other end in the penetration direction L of the outer peripheral core 6. The casing 11 is configured to accommodate the primary coil 21, the secondary coil 22, the center core 5, the outer peripheral core 6 and the core cover 7 from an opening 111 formed on the side on which the surface 62 on one end of the outer peripheral core 6 in the penetration direction L is arranged. The filling resin 13 fills gaps in the casing 11.

Figure 4:
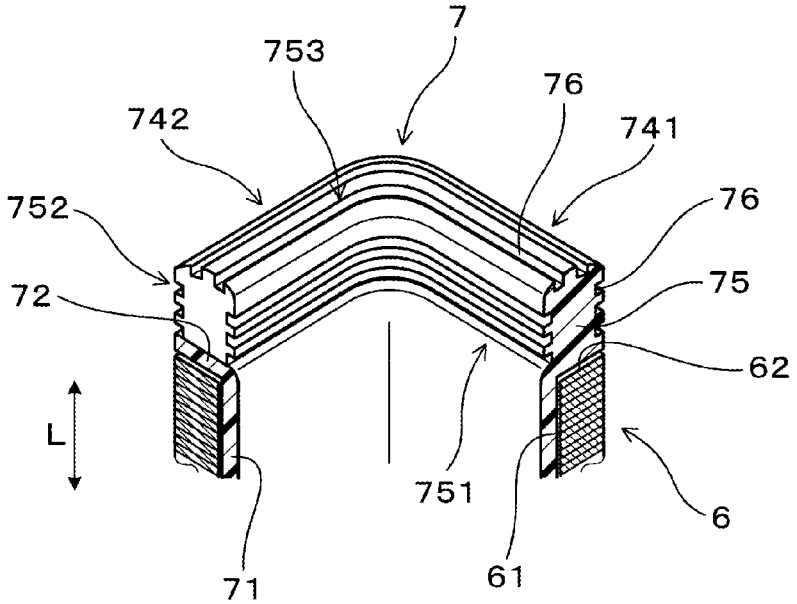
FIG. 4 is a perspective view illustrating the outer peripheral core and the core cover as viewed from the inside, according to the first embodiment.
Figure 5:
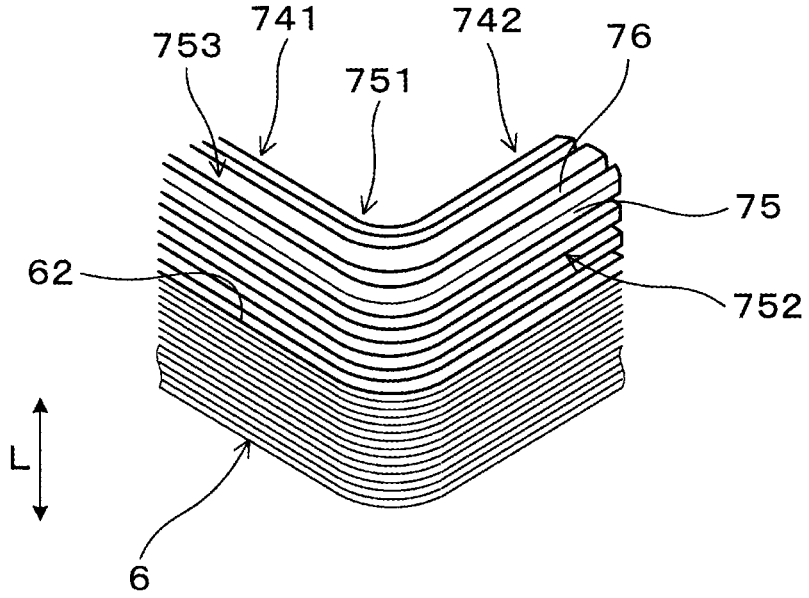
FIG. 5 is a perspective view illustrating the core cover and the outer peripheral core as viewed from the outside, according to the first embodiment.
Figure 6:
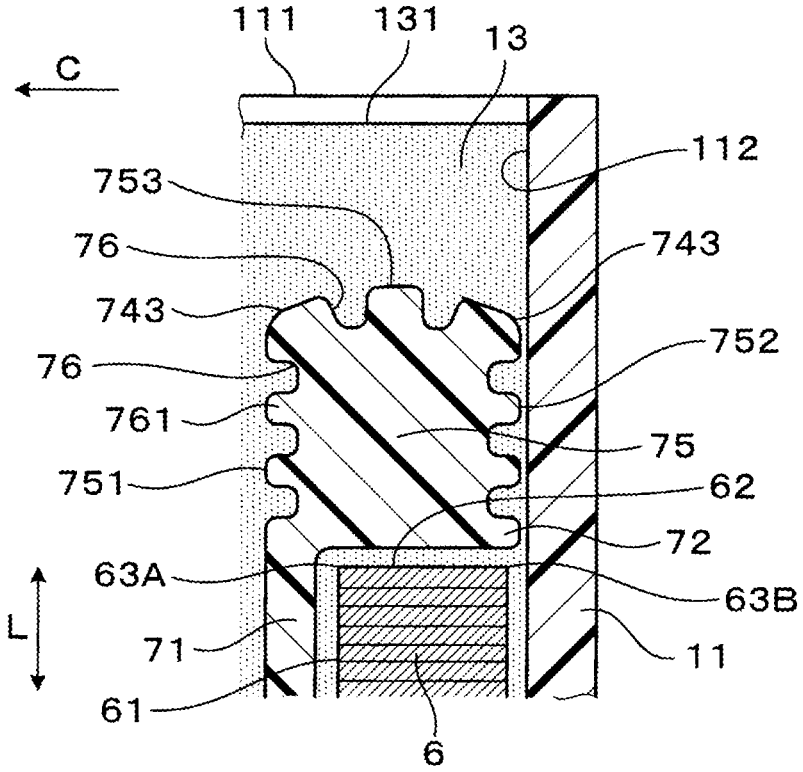
FIG. 6 is an enlarged cross-sectional view illustrating a wall portion of the core cover as well as the peripheral components, according to the first embodiment.

As shown in FIGS. 4 to 6, the core cover 7 has a one-end-side cover part 72 facing the surface 62 on one end of the outer peripheral core 6. The cover part 72 has a wall portion 75 formed in a portion located on the high-voltage side of the secondary coil 22. The wall portion 75 has an inner surface 751, an outer surface 752, and a surface 753 on one end in the penetration direction L. In all of the surfaces 751, 752 and 753, a plurality of continuous grooves 76 are formed as recesses. The plurality of continuous grooves 76 are filled with the filling resin 13 which is filled in the casing 11.

With reference to FIGS. 1 to 9, the ignition coil 1 of the present embodiment will hereinafter be described.

The ignition coil 1 is arranged in each cylinder of the engine, and generates a sparking voltage for generating a spark from a spark plug arranged in a plug hole of each cylinder.

In the ignition coil 1 of the present embodiment, the primary coil 21, the secondary coil 22, the center core 5 and the outer peripheral core 6 are arranged in an outer part of the plug hole. In the plug hole, a joint part 12 connected to the spark plus is arranged.

As shown in FIGS. 1 and 2, the center core 5 is formed in a cuboid-shape. The primary coil 21 is wound around the outer periphery of a primary spool 3 having a substantially quadrilateral-cylinder-shaped cross section with rounded corners. The secondary coil 22 is wound around the outer periphery of a secondary spool 4 having a substantially quadrilateral-cylinder-shaped cross section with rounded corners. The outer peripheral core 6 is formed to a substantially rectangular-ring-shape with rounded outside corners. The electromagnetic steel sheets configuring the center core 5 and the outer peripheral core 6 are stacked in the penetration direction L of the outer peripheral core 6. The penetration direction L of the outer peripheral core 6 coincides with a direction in which the opening 111 is provided in the casing 11. The casing 11 is formed to a substantially cuboid vessel shape conforming to the substantially rectangular-ring-shaped outer peripheral core 6. The casing 11 has the opening 111 on the side opposite to the side on which the joint part 12 is formed in the ignition coil 1.

The primary spool 3 has a cylindrical portion 31 around which the primary coil 21 is wound, and a connector portion 32 connected to an end of the cylindrical portion 31. In the casing 11, an igniter 33 is arranged, with a switching element being integrated to supply or interrupt current to the primary coil 21. The secondary spool 4 has a cylindrical portion 41 around which the secondary coil 22 is wound. A part of the connector portion 32 of the primary spool 3 is fitted in a notched part formed in the casing 11 to constitute a part of the casing 11.

In the casing 11, the filling resin 13, which is a thermosetting resin such as an epoxy resin, insulates and adheres the primary coil 21 and the secondary coil 22 and the like from/with each other.

Figure 3:
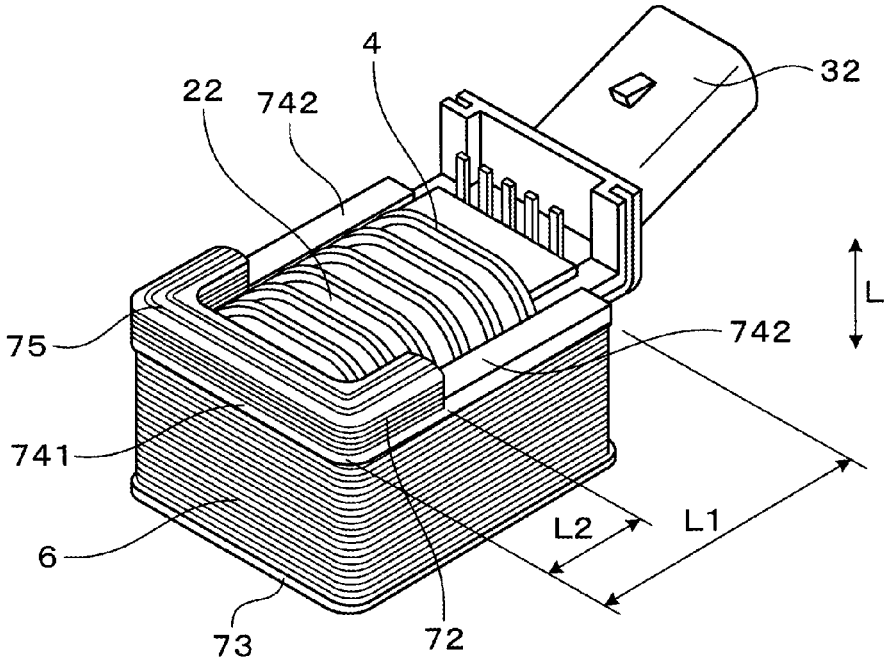
FIG. 3 is a perspective view illustrating an outer peripheral core and a core cover as well as the peripheral components, according to the first embodiment.

As shown in FIGS. 1 to 3, the core cover 7 is provided substantially the entire periphery of the substantially quadrilateral-cylinder-shaped outer peripheral core 6. In the outer peripheral core 6, the core cover 7 covers the inner surface 61, the surface 62 on one end in the penetration direction L, and the surface 63 on the other end in the penetration direction L to relieve the thermal stress produced in the filling resin 13 due to the difference in the coefficient of thermal expansion between the filling resin 13 and the outer peripheral core 6. The core cover 7 has an inner cover part 71 facing the inner surface 61 of the outer peripheral core 6, the one end-side cover part 72 facing the surface 62 on one end of the outer peripheral core 6 in the penetration direction L, and another end-side cover part 73 facing the surface 63 on the other end of the outer peripheral core 6 in the penetration direction L. The one end-side cover part 72 and the other end-side cover part 73 are connected to each other by the inside cover part 71.

The core cover 7 can be formed being divided into a plurality of segments so as to be assembled to the outer peripheral core 6.

As shown in FIG. 3, the wall portion 75 of the core cover 7 is formed so as to be projected from the portion of the one end-side cover part 72, the portion being located on the high-voltage side of the secondary coil 22, toward the one end side in the penetration direction L. The thermal stress produced in the filling resin 13 is efficiently relaxed by increasing the thickness of the one end-side cover part 72 in the penetration direction L with the wall portion 75. The wall portion 75 of the present embodiment is formed on a high voltage-side side part 741, and a part of a pair of opposing side parts 742 continuing from the high voltage side part 741 and opposing each other, which are located on the high-voltage side of the secondary coil 22, among the four side parts constituting the substantially quadrilateral-cylinder-shaped core cover 7. When L1 is defined as a total length of the pair of opposing side parts 742, a length L2 along which the wall portion 75 is formed on the pair of opposing side parts 742, can be set to a range of 0.3 L1 to 0.5 L1.

The wall portion 75 may be formed in only the high voltage-side side part 741 of the core cover 7. Further, the core cover 7 may be provided at only the high voltage-side portion of the outer peripheral cover, other than being provided at substantially the entire periphery of the outer peripheral core 6.

As shown in FIGS. 4 and 5, the plurality of continuous grooves 76 are formed in the wall portion 75 of the present embodiment so as to be in parallel to each other along the annular direction of the outer peripheral core 6. The plurality of continuous grooves 76 are formed in each of all the inner surface 751, the outer surface 752, and the surface 753 on one end in the penetration direction L of the wall portion 75. In the present embodiment, three continuous grooves 76 are formed side by side in parallel to each other in the penetration direction L in each of the inner and outer surfaces 751 and 752 of the wall portion 75, while two continuous grooves 76 are formed side by side in parallel to each other along the inner and outer peripheries in the surface 753 on one end in the penetration direction L of the wall portion 75. Further, each of the continuous grooves 76 is continuously formed from an end face to the other end face of the wall portion 75. Further, in the rest of the wall portion 75 not formed with the continuous grooves 76, a plurality of projections 761 are continuously formed being extended in the annular direction of the outer peripheral core 6.

As shown in FIG. 6, in the cross-section orthogonal to the annular direction, the surface 753 on one end in the penetration direction L of the wall portion 75 has an arc shape. The surface 753 on one end in the penetration direction L of the wall portion 75 has inner and outer corners 743 which are each formed into a curved shape.

Minute gaps are formed between the outer surface of the outer peripheral core 6 and an inner wall surface 112 of the casing 11, between the outer surface 752 of the wall portion 75 of the core cover 7 and the inner wall surface 112 of the casing 11, and between the outer peripheral core 6 and the core cover 7. The minute gaps are filled with the filling resin 13.

The gap between the wall portion 75 of the core cover 7 and the inner wall surface 112 of the casing 11 can be eliminated.

Specifically, the dimension between portions of the outer surface 752 of the wall portion 75 on the pair of opposing side parts 742 of the core cover 7 may be made larger than the dimension between portions of the inner wall surface 112 of the casing 11 respectively facing the portions of the outer surface 752, so that the outer surface 752 of the wall portion 75 on the pair of opposing side parts 742 can contact the inner wall surface 112 of the casing 11. Further, the dimension between the outer surface 752 of the wall portion 75 on the high voltage-side side part 741 of the core cover 7 and a portion of the connector portion 32 forming the casing 11 may be made larger than the dimension between portions of the inner wall surface 112 of the casing 11 respectively facing the outer surface 752 and the portion of the connector portion 32, so that the outer surface 752 of the wall portion 75 of the high voltage-side side part 741 can contact the inner wall surface 112 of the casing 11. In these cases, the progression of the separation caused in the interface between the core cover 7 and the filling resin 13 is suppressed by the intimately contacting portions between the plurality of projections 761 and the inner wall surface 112 of the casing 11, and the plurality of continuous grooves 76.

The center core 5 and the outer peripheral core 6 are made of a soft magnetic material. The coefficient of thermal expansion (linear expansion coefficient) of the center core 5 and the outer peripheral core 6 is smaller than that of the filling resin 13 that is a thermosetting resin. The coefficient of thermal expansion of the core cover 7 has an intermediate value between the coefficient of thermal expansion of the center core 5 and the outer peripheral core 6 and the coefficient of thermal expansion of the filling resin 13. When the ignition coil 1 is cooled in the heating and cooling cycle of the engine, the expanded filling resin 13 contracts. When the contraction of the filling resin 13 is stopped by the outer peripheral core 6, a thermal stress acts on the filling resin 13. Since the core cover 7 is provided to the outer peripheral core 6, the thermal stress acting from the filling resin 13 to the outer peripheral core 6 is relaxed.

Figure 7:
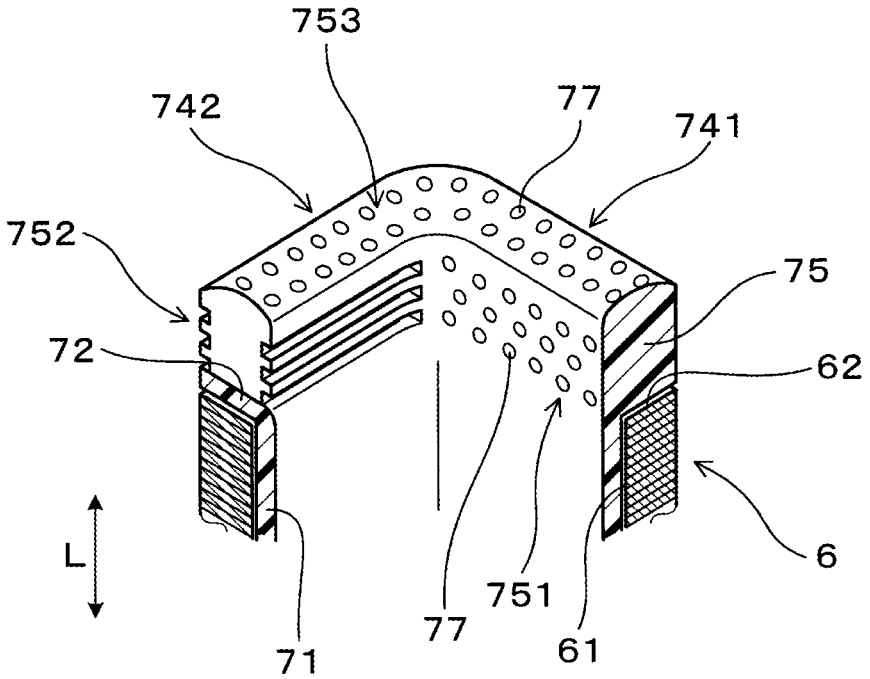
FIG. 7 is a perspective view illustrating another core cover and outer peripheral core as viewed from the inside, according to the first embodiment.
Figure 8:
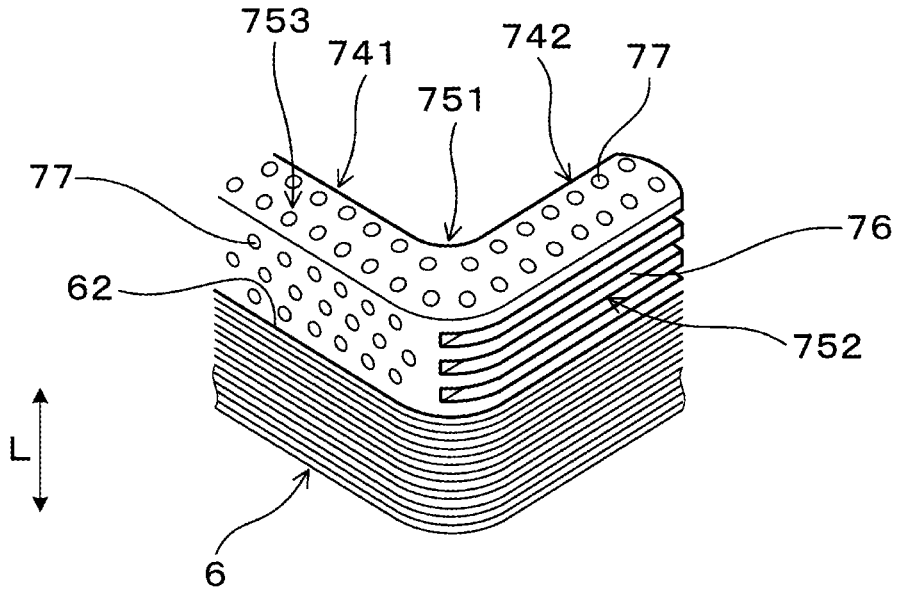
FIG. 8 is a perspective view illustrating another core cover and outer peripheral core as viewed from the outside, according to the first embodiment.
Figure 9:
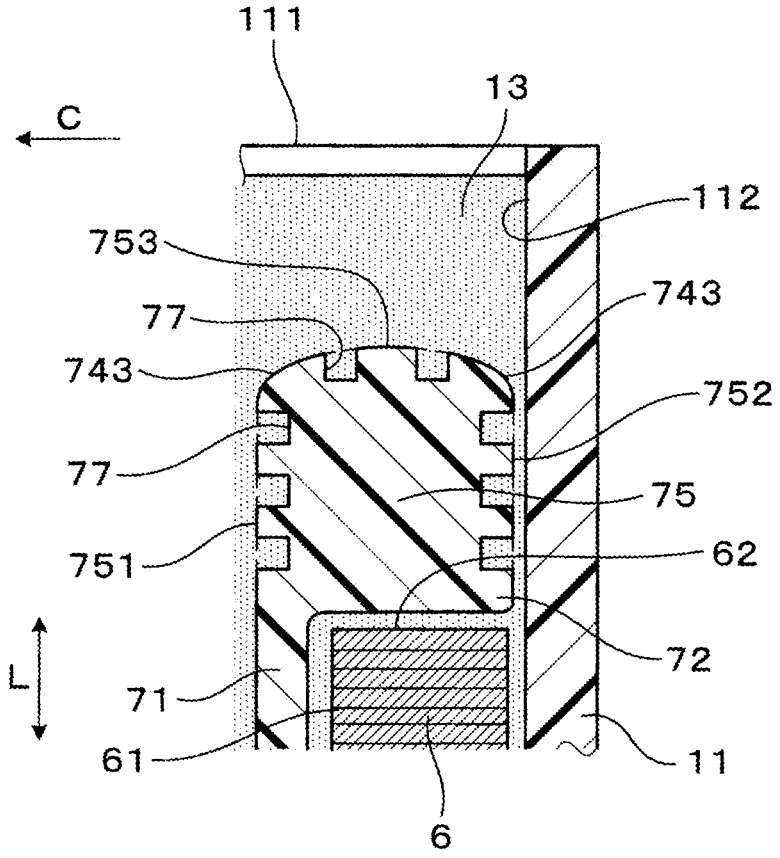
FIG. 9 is an enlarged cross-sectional view illustrating a wall portion of another core cover as well as the peripheral components, according to the first embodiment.
Figure 10:
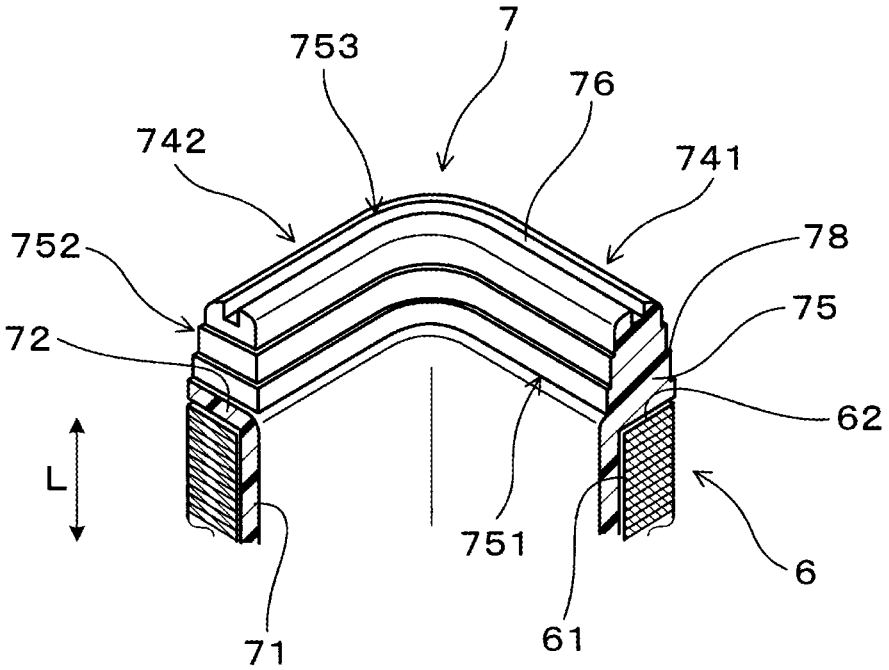
FIG. 10 is a perspective view illustrating a core cover and an outer peripheral core as viewed from the inside, according to a second embodiment.
Figure 11:
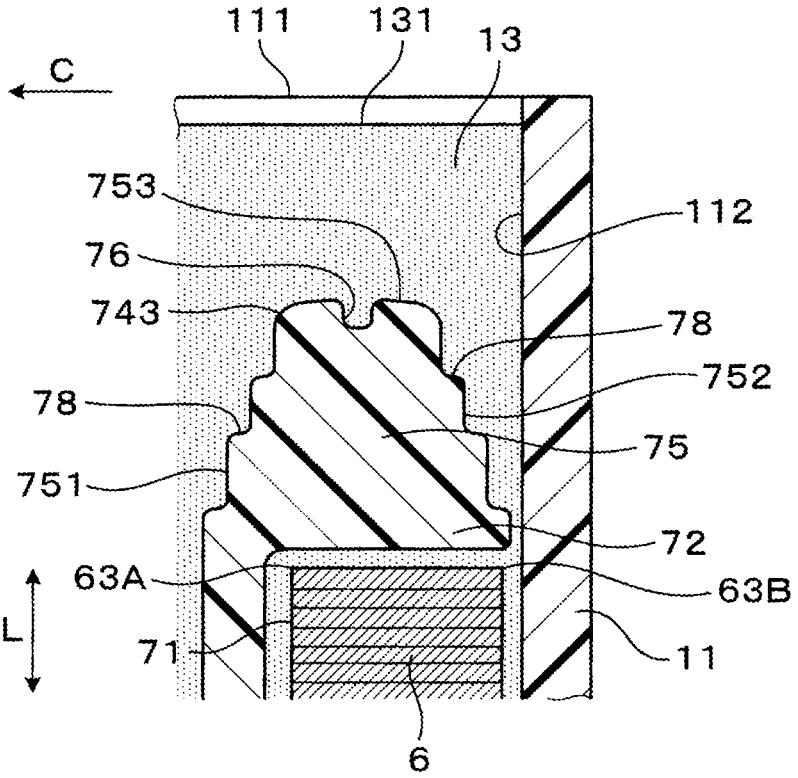
FIG. 11 is an enlarged cross-sectional view illustrating a wall portion of the core cover as well as the peripheral components, according to the second embodiment.

As shown in FIGS. 7 to 9, the recesses provided in the wall portion 75 of the core cover 7 may be replaced by a plurality of recessed holes 77. In the wall portion 75, the recessed holes 77 may be repeatedly formed along the annular direction of the outer peripheral core 6 and the direction orthogonal to the annular direction. Alternatively, in the wall portion 75 a plurality of continuous grooves 76 may be combined with a plurality of recessed holes 77 to prevent an undercut from being formed when forming the core cover 7. For example, as shown in FIGS. 7 and 8, a plurality of continuous grooves 76 may be formed in the inner surface 751 and the outer surface 752 of the wall portion 75 on the pair of opposing parts 742, and a plurality of recessed holes 77 may be formed in the inner surface 751, the outer surface 752 and the surface 753 on one end in the penetration direction L of the remaining wall portion 75.

Hereinafter will be described advantageous effects of the ignition coil of the present embodiment.

As shown in FIG. 6, the interface between the core cover 7 and the filling resin 13 is brought into a state in which separation is easily caused by the thermal stress produced in the filling resin 13 due to the difference in the coefficient of thermal expansion between the outer peripheral core 6 and the filling resin 13. The separation caused in the interface between the core cover 7 and the filling resin 13 progresses toward an end in the penetration direction L of the core cover 7 over the interface. When the separation reaches the corners of the core cover 7 at the end in the penetration direction L, cracks are generated in the filling resin 13 due to the stress concentration. It is known that, thereafter, the cracking progresses to an end surface 131 of the filling resin 13 located at the opening 111 of the casing 11. Specifically, the high voltage side of the secondary coil 22, will have a high voltage, and thus, is likely to suffer from voltage leaking due to the occurrence of cracks.

In the ignition coil 1 of the present embodiment, the core cover 7 has the one end-side cover part 72 facing the surface 62 on one end of the outer peripheral core 6 in the penetration direction L. Further, the wall portion 75 is formed on a part of the high voltage-side side part 741 and the pair of opposing side parts 742. In the wall portion 75, the plurality of continuous grooves 76 are formed for resisting the thermal contraction of the filling resin 13 caused in the heating and cooling cycle of the engine, or for preventing the separation from progressing to cracks.

As shown in FIG. 6, when the ignition coil 1 is cooled in the heating and cooling cycle of the engine, the filling resin 13 thermally contracts toward the center of a plane (indicated by the reference sign C in FIG. 6) orthogonal to the penetration direction L of the outer peripheral core 6. At this time, the portion of the filling resin 13 filled in the plurality of continuous grooves 76 is latched to the plurality of continuous grooves 76 in the surface 753 on one end in the penetration direction L of the wall portion 75 of the core cover 7. Accordingly, the thermal contraction of the filling resin 13 is prevented to thereby prevent the occurrence of separation. Therefore, if separation occurs, the progression of separation is suppressed, and as a result, cracking is unlikely to occur in the filling resin 13. Therefore, the lifetime of the ignition coil 1 is extended. Also, in the case where a plurality of recessed holes 77 are formed in the wall portion 75 (refer to FIG. 9), advantageous effects similar to those in the case of forming a plurality of continuous grooves 76 can be obtained.

The separation occurred at the interface between the core cover 7 and the filling resin 13 near an outer corner 63B, which is located on the outer side of the surface 62 on one end of the outer peripheral core 6 in the penetration direction L, progresses over the interface between the plurality of continuous grooves 76 and the filling resin 13 in the outer surface 752 of the wall portion 75 of the core cover 7. The separation occurred at the interface between the cover 7 covering an inner corner 63A of the outer peripheral core 6 and the filling resin 13 progresses over the interface between the plurality of continuous grooves 76 and the filling resin 13 in the inner surface 751 of the wall portion 75 of the core cover 7. In these cases, a creepage distance can be increased. The creepage distance in these cases is a distance through which separation progresses to a corner at an end of the core cover 7 in the penetration direction L. Therefore, separation is unlikely to progress to the corner at an end of the core cover 7 in the penetration direction L. Moreover, the cracking in the filling resin 13 is suppressed to extend the lifetime of the ignition coil 1. Also, in the case where a plurality of recessed holes 77 are formed in the wall portion 75 (refer to FIG. 9), advantageous effects similar to those in the case of forming a plurality of continuous grooves 76 can be obtained.

In the ignition coil 1 of the present embodiment, the occurrence or the progression of separation is suppressed by forming a plurality of continuous grooves 76 in the wall portion 75 of the core cover 7. The core cover 7 does not require the use of a stress relaxing material or the like which is prepared separately from the core cover 7 and the labor for the assembly of the ignition coil 1 does not increase. Furthermore, without the need of forming a gap in the casing 11 for the arrangement of the stress relaxing material or the like, the ignition coil 1 is prevented from becoming large.

Therefore, with the ignition coil 1 of the present embodiment, the occurrence or the progression of separation in the interface between the core cover 7 and the filling resin 13 is suppressed, and the lifetime of the ignition coil 1 is extended.

(Second Embodiment)

The present embodiment shows the case in which a plurality of steps 78 are formed on the inner surface 751 and the outer surface 752 of the wall portion 75 of the core cover 7.

The plurality of steps 78 of the present embodiment are formed in a step shape in which the width between the inner and outer surfaces 751 and 752 of the wall portion 75 is gradually narrowed toward one end side in the penetration direction L. The surface 753 on one end in the penetration direction L of the wall portion 75 of the present embodiment includes the continuous grooves 76 which are formed along the annular direction of the outer peripheral core 6.

In the ignition coil 1 of the present embodiment, separation occurred at the interface between the core cover 7 and the filling resin 13 near the outer corner 63B, which is located on the surface 62 on one end of the outer peripheral core 6 in the penetration direction L, progresses over the interface between the plurality of steps 78 and the filling resin 13 in the outer surface 752 of the wall portion 75 of the core cover 7. Further, separation occurred at the interface between the core cover 7 covering the inner corner 63A of the outer peripheral core 6 and the filling resin 13 progresses over the interface between the plurality of steps 78 and the filling resin 13 in the inner surface 751 of the wall portion 75 of the core cover 7. In these cases, a creepage distance is increased. The creepage distance in these cases is a distance through which separation progresses to the corner 743 on one end side in the penetration direction L of the core cover 7. Therefore, separation is unlikely to progress to the corner 743 on one end side in the penetration direction L of the core cover 7, cracks which would occur in the filling resin 13 are suppressed, and the lifetime of the ignition coil 1 can be extended.

In the ignition coil 1 of the present embodiment, the rest of the configuration and the reference signs in the drawings are the same as those of the first embodiment, and thus advantageous effects similar to those of the first embodiment can be obtained.

The invention claimed is:

1. An ignition coil for an internal combustion engine comprising:

a primary coil;

a secondary coil disposed concentrically around the outer periphery of the primary coil;

a center core disposed on the inner periphery of the primary coil;

an outer peripheral core surrounding the secondary coil, the outer peripheral core including a central opening;

a core cover including an inside cover part facing an inner surface of the outer peripheral core, a first end-side cover part facing a surface on one end of the outer peripheral core in a penetration direction, and a second end-side cover part facing a surface of the other end of the outer peripheral core in the penetration direction, the first end-side cover part and the second end-side cover part being connected by the inside cover part, the first end-side cover part of the core cover only including a wall portion that is on a high voltage side of the secondary coil such that the core cover does not include another wall portion elsewhere and that protrudes in the penetration direction, the core cover having a plurality of steps formed on at least one of an inner surface of the wall portion, an outer surface of the wall portion, and a surface on one end of the wall portion in the penetration direction of the core cover;

a case provided with an accommodation opening on a side on which the surface on the one end of the outer peripheral core in the penetration direction is located, the accommodation opening accommodating the primary coil, the secondary coil, the center core, the outer peripheral core, and the core cover; and a filling resin filling gaps in the case, the filling resin being in contact with the steps.

2. The ignition coil for the internal combustion engine according to claim 1, wherein the steps are formed in the inner surface and the outer surface of the wall portion so as to have a step shape in which the width between the inner surface and the outer surface of the wall portion becomes gradually narrower toward the one end of the wall portion in the penetration direction.

3. The ignition coil for the internal combustion engine according to claim 1, wherein the wall portion has an inner corner and an outer corner, wherein each of the inner corner and the outer corner is formed into a curved shape, and located on the surface on the one end of the wall portion in the penetration direction.

4. The ignition coil for the internal combustion engine according to claim 2, wherein at least one continuous groove is formed in the surface on the one end of the wall portion in the penetration direction of the core cover.

5. An ignition coil for an internal combustion engine comprising:

a primary coil;

a secondary coil disposed concentrically around the outer periphery of the primary coil;

a center core disposed on the inner periphery of the primary coil;

an outer peripheral core surrounding the secondary coil, the outer peripheral core including a central opening;

a core cover including an inside cover part facing an inner surface of the outer peripheral core, a first end-side cover part facing a surface on one end of the outer peripheral core in a penetration direction, and a second end-side cover part facing a surface on the other end of the outer peripheral core in the penetration direction, the first end-side cover part and the second end-side cover part being connected by the inside cover part, the first end-side cover part of the core cover only including a wall portion that is on a high voltage side of the secondary coil such that the core cover does not include another wall portion elsewhere and that protrudes in the penetration direction, the core cover having a plurality of continuous grooves formed on at least one of an inner surface of the wall portion, an outer surface of the wall portion, and a surface on one end of the wall portion in the penetration direction;

a case provided with an accommodation opening on a side on which the surface on the one end of the outer peripheral core in the penetration direction is located, the accommodation opening accommodating the primary coil, the secondary coil, the center core, the outer peripheral core, and the core cover; and a filling resin filling gaps in the case, the filling resin being in contact with the continuous grooves.

6. The ignition coil for the internal combustion engine according to claim 5, wherein the plurality of continuous grooves are formed in the wall portion so as to be parallel to each other along a circumferential direction of the outer peripheral core.

7. The ignition coil for the internal combustion engine according to claim 6, wherein the plurality of continuous grooves are formed in each of the inner surface, the outer surface and the surface on the one end of the wall portion in the penetration direction.

8. The ignition coil for the internal combustion engine according to claim 5, wherein a plurality of steps are formed in the inner surface and the outer surface of the wall portion so as to have a step shape in which the width between the inner surface and the outer surface of the wall portion becomes gradually narrower toward the one end of the wall portion in the penetration direction.

9. The ignition coil for the internal combustion engine according to claim 5, wherein the wall portion has an inner corner and an outer corner, wherein each of the inner corner and the outer corner is formed into a curved shape, and located on the surface on one end of the wall portion in the penetration direction.

10. An ignition coil for an internal combustion engine comprising:

a primary coil;

a secondary coil disposed concentrically around the outer periphery of the primary coil;

a center core disposed on the inner periphery of the primary coil;

an outer peripheral core surrounding the secondary coil, the outer peripheral core including a central opening;

a core cover including an inside cover part facing an inner surface of the outer peripheral core, a first end-side cover part facing a surface on one end of the outer peripheral core in a penetration direction, and a second end-side cover part facing a surface on the other end of the outer peripheral core in the penetration direction, the first end-side cover part and the second end-side cover part being connected by the inside cover part, the first end-side cover part of the core cover only including a wall portion that is on a high voltage side of the secondary coil such that the core cover does not include another wall portion elsewhere and that protrudes in the penetration direction, the core cover having a plurality of continuous grooves formed on at least one of an inner surface of the wall portion, an outer surface of the wall portion, and a surface on one end of the wall portion in the penetration direction, and the core cover having a plurality of holes formed in the wall portion arranged along a circumferential direction of the outer peripheral core and arranged along a direction orthogonal to the circumferential direction;

a case provided with an accommodation opening on a side on which the surface on the one end of the outer peripheral core in the penetration direction is located, the accommodation opening accommodating the primary coil, the secondary coil, the center core, the outer peripheral core, and the core cover; and a filling resin filling gaps in the case, the filling resin being in contact with the grooves and the holes.

* * * * *